US006296626B1

(12) United States Patent
Stein

(10) Patent No.: US 6,296,626 B1
(45) Date of Patent: Oct. 2, 2001

(54) EYE WASH STATION

(75) Inventor: Matthew Isaac Stein, Truckee, CA (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 09/191,847

(22) Filed: Nov. 13, 1998

(51) Int. Cl.[7] ..... A61H 33/04
(52) U.S. Cl. ..... 604/294; 604/295; 4/620
(58) Field of Search ..... 4/619, 620, 623, 4/624, 615; 604/294, 295, 300

(56) References Cited

U.S. PATENT DOCUMENTS

| | | | |
|---|---|---|---|
| D. 342,309 | | 12/1993 | Peterson et al. . |
| 2,910,064 | | 10/1959 | Brangaitis . |
| 2,999,249 | | 9/1961 | Logan et al. . |
| 3,106,722 | | 10/1963 | Logan et al. . |
| 4,012,798 | | 3/1977 | Liautaud . |
| 4,363,146 | * | 12/1982 | Liautaud ..... 4/620 |
| 4,493,119 | | 1/1985 | Baumann . |
| 4,641,384 | | 2/1987 | Landsberger et al. . |
| 4,675,924 | | 6/1987 | Allison et al. . |
| 4,688,276 | | 8/1987 | Allison et al. . |
| 4,758,237 | | 7/1988 | Sacks . |
| 4,881,283 | | 11/1989 | Liautaud . |
| 4,939,800 | | 7/1990 | Fiorentino et al. . |
| 5,157,798 | * | 10/1992 | Van Kammen ..... 4/620 |
| 5,216,765 | | 6/1993 | Paterson et al. . |
| 5,320,615 | | 6/1994 | Van Keuren . |
| 5,381,567 | | 1/1995 | Tanner et al. . |
| 5,530,972 | | 7/1996 | Tanner . |
| 5,566,406 | | 10/1996 | Demeny et al. . |
| 5,607,410 | | 3/1997 | Branch . |

* cited by examiner

*Primary Examiner*—Kim M. Lewis
(74) *Attorney, Agent, or Firm*—Foley & Lardner

(57) ABSTRACT

An eye wash station is disclosed for dispensing a fluid to a person's eyes. The eye wash station includes a tank to contain the fluid and a pedestal having a tank support portion and a generally horizontal base portion. The eye wash station has a reservoir configured to maintain a substantially constant level of the fluid within the reservoir when the tank is installed. A dispensing arm providing a flow outlet is pivotally mounted to the pedestal for movement between a stowed position where the flow outlet is above the reservoir fluid level and an operating position wherein the flow outlet is below the reservoir fluid level. A conduit, such as a length of flexible tubing or hose, couples the reservoir to the flow outlet to allow flow of the fluid from the reservoir to the flow outlet when the dispensing arm is in the operating position, and a pair of spray heads coupled to the flow outlet provide a spray of the fluid. The eye wash station may further include a fluid drain coupled to a basin disposed within the base portion of the pedestal, as well as a pinch valve to restrict flow of fluid through the conduit while the tank is being installed or maintained. The pinch valve and conduit are configured to automatically reset to the open (i.e., disengaged) position when the dispensing arm is raised to the stowed position. The tank outlet may include a tank lid with a seal that is pierced by a piercing part in the reservoir while the tank is being installed. The eye wash station may further include a V-shaped retaining profile upon the upper surface of the tank support portion of the pedestal and a corresponding V-shaped retaining profile upon the bottom surface of the tank to facilitate a secure fit of the tank to the pedestal. A method of preparing the tank for use is also disclosed.

45 Claims, 8 Drawing Sheets

EYE WASH STATION

FIELD OF THE INVENTION

The present invention relates to an eye wash station. More particularly, the present invention relates to a portable eye wash station having a fluid tank and a constant-level fluid reservoir. Still more particularly, the present invention relates to a portable eye wash station having a dispensing arm providing a flow outlet and pivotally mounted to a pedestal.

BACKGROUND OF THE INVENTION

It is generally known to provide an eye wash station configured for flooding or rinsing of one or both of the eyes of a person (e.g., a worker or other user) with water or a fluid solution in order to remove, dilute, or neutralize a contaminant or other foreign material.

Some known eye wash stations are connected to a building water supply (i.e., plumbing) system, and are configured to spray a water stream (typically cold water) into one or both of the user's eyes upon the opening of a valve in communication with the supply. In such known eye wash stations, there is the possibility of the water stream containing corrosion or scale particles or organic growths. Because such eye wash stations are typically used infrequently, upon opening of the valve any stagnant water and debris (e.g., corrosion products) in the piping of the water supply system to the eye wash station may be flushed into the user's eyes. Moreover, such eye wash stations are not portable for use in non-stationary work places.

Portable eye wash stations are also generally known. Such known portable eye wash stations typically include a tank of fluid which is elevated with respect to a flow outlet configured to spray a fluid stream into the user's eyes. In some known eye wash stations, the tank is permanently affixed within the eye wash station. The tank, which must be refilled after the station has been used or on a periodic maintenance basis, can be difficult to refill without spillage or without introducing contaminant (such as dust from ambient air or foreign material rinsed from the region of the tank refill port by fluid which may strike the rim before going into the tank). It may be unwieldy to transport the eye wash station itself. Other generally known eye wash stations have tanks which are removable. The tank of such known eye wash stations may be unwieldy and difficult to align during installation.

Known portable eye wash stations including elevated tanks for gravity feed of fluid to a user's eyes include valves for turning flow of fluid on or off. Valves in general include elastomeric or plastomeric seals which are subject to degradation by age, heat, and/or environmental contaminants. Further, the fluid pressure at an eye wash spray nozzle is a function of fluid head at the inlet to the nozzle. As fluid is used and the tank is gradually emptied, the fluid height within the tank, the consequent hydraulic head at the spray nozzle inlet, and thereby both fluid flow rate through the spray nozzle and height of a spray pattern from the spray nozzle gradually diminish.

Accordingly, it would be advantageous for a portable eye wash station to include a removable tank configured for convenient installation. It would also be advantageous for a portable eye wash station to be configured for ease of use, for example wherein a user does not have to actuate a valve to start flow of eye wash fluid. It would further be advantageous for a portable eye wash station to include a constant level reservoir, configured to provide a substantially constant hydraulic head to eye wash spray nozzles and thereby a substantially constant fluid flow rate and height of spray pattern.

SUMMARY OF THE INVENTION

The present invention relates to an eye wash station for dispensing a fluid to a user's eyes. The eye wash station includes a tank to contain the fluid; a pedestal having a tank support portion and a generally horizontal basin portion, the tank support portion including a reservoir configured to maintain the fluid at a substantially constant reservoir fluid level when the tank is installed; a dispensing arm providing a flow outlet and pivotally mounted to the pedestal for movement about a horizontal transverse axis between a stowed position where the flow outlet is above the constant reservoir fluid level and an operating position wherein the flow outlet is below the constant reservoir fluid level; a conduit coupling the reservoir to the flow outlet to allow the flow of the fluid from the reservoir to the flow outlet when the dispensing arm is in the operating position; and a pair of spray heads associated with or part of the flow outlet and configured to provide a spray of the fluid into each of a user's eyes.

The present invention also relates to a method of preparing a tank having an outlet and adapted to contain fluid for use with an eye wash station having a base with a reservoir and a piercing part. The method includes the steps of at least partially filling the tank with the fluid and applying a pierceable seal to the outlet of the tank.

DETAILED DESCRIPTION OF THE PREFERRED EMBODIMENTS

Figure 1:
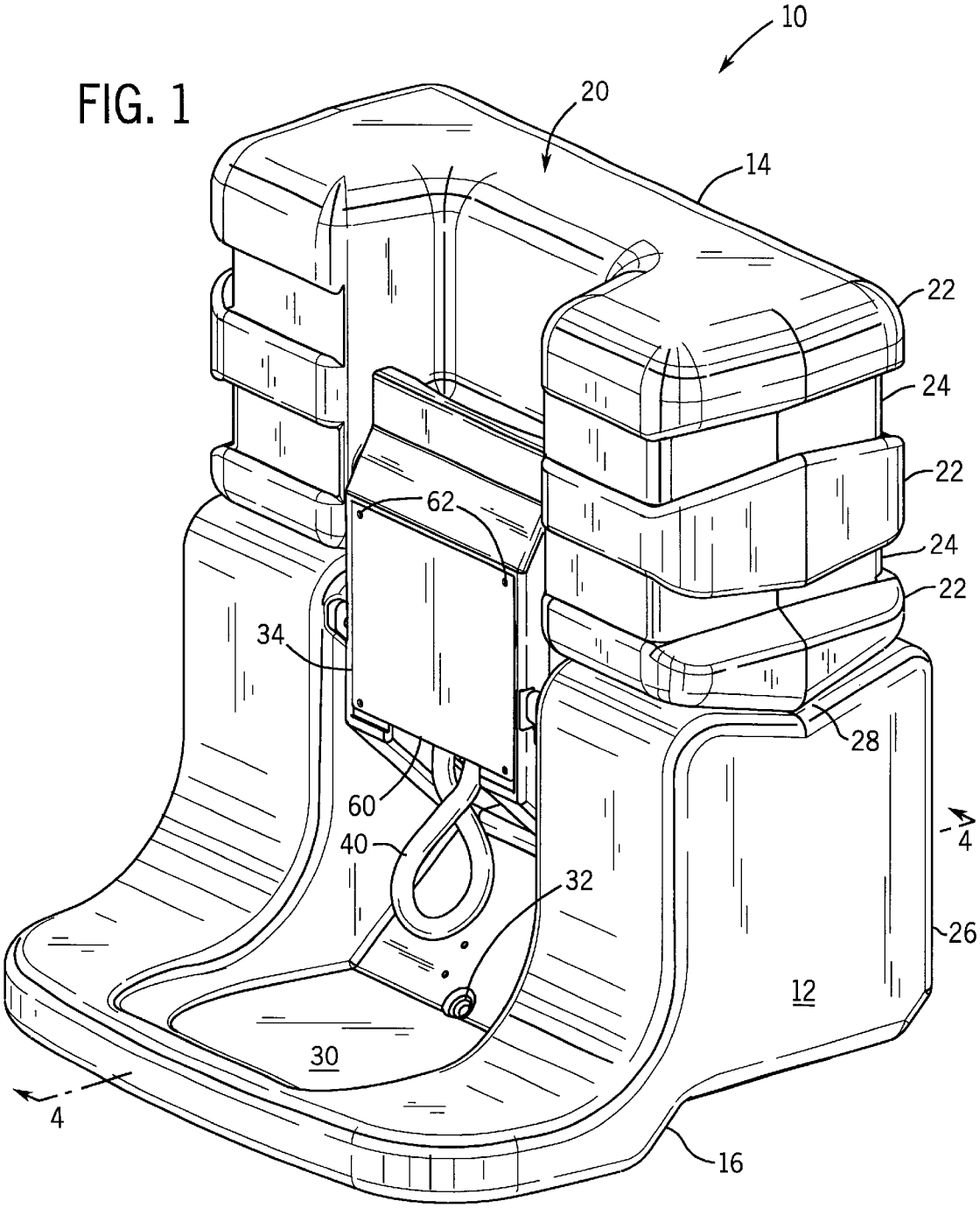
FIG. 1 is a perspective view of a preferred embodiment of an eye wash station showing a dispensing arm in a stowed position.
Figure 3:
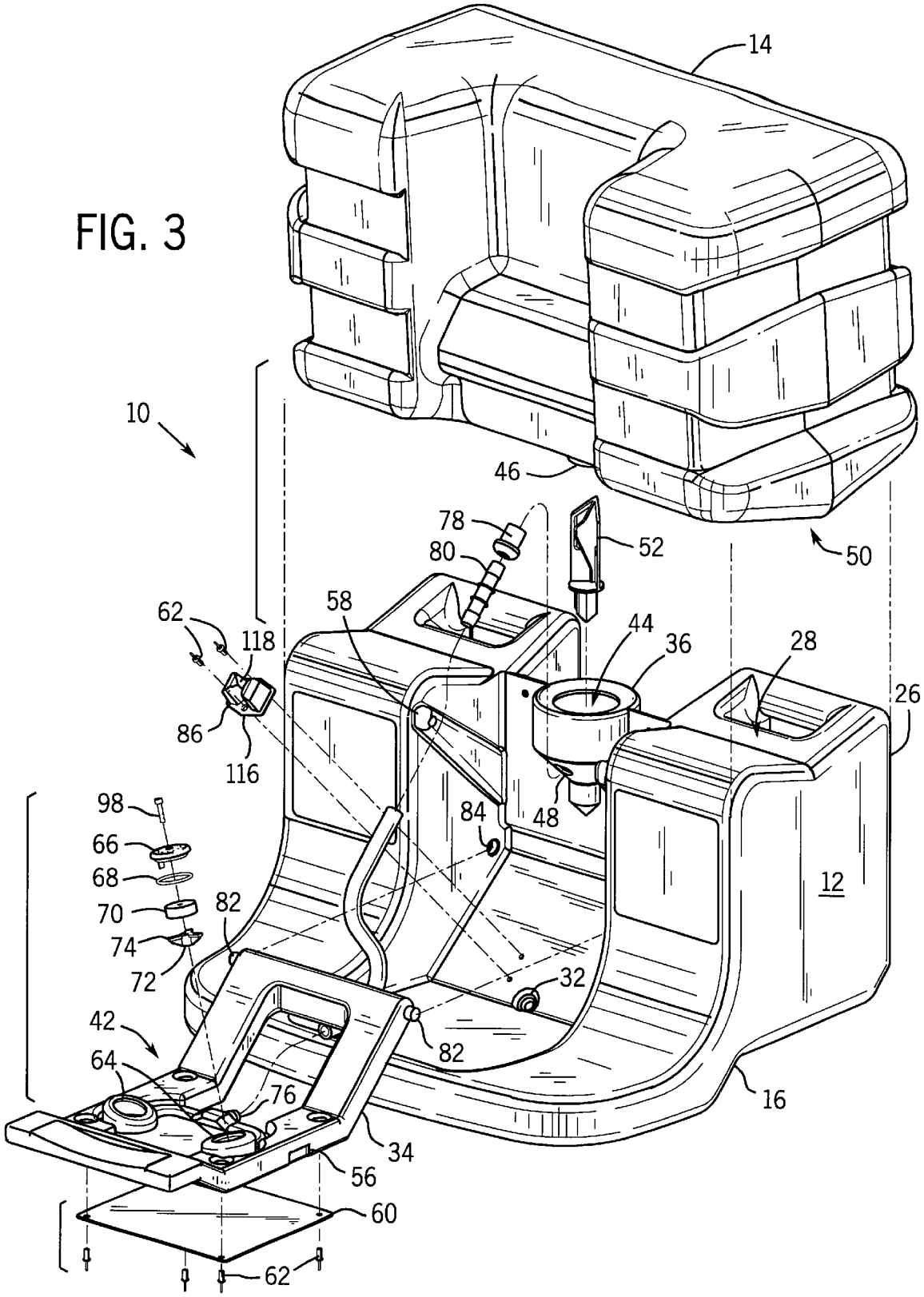
FIG. 3 is an exploded perspective view of the eye wash station.
Figure 8:
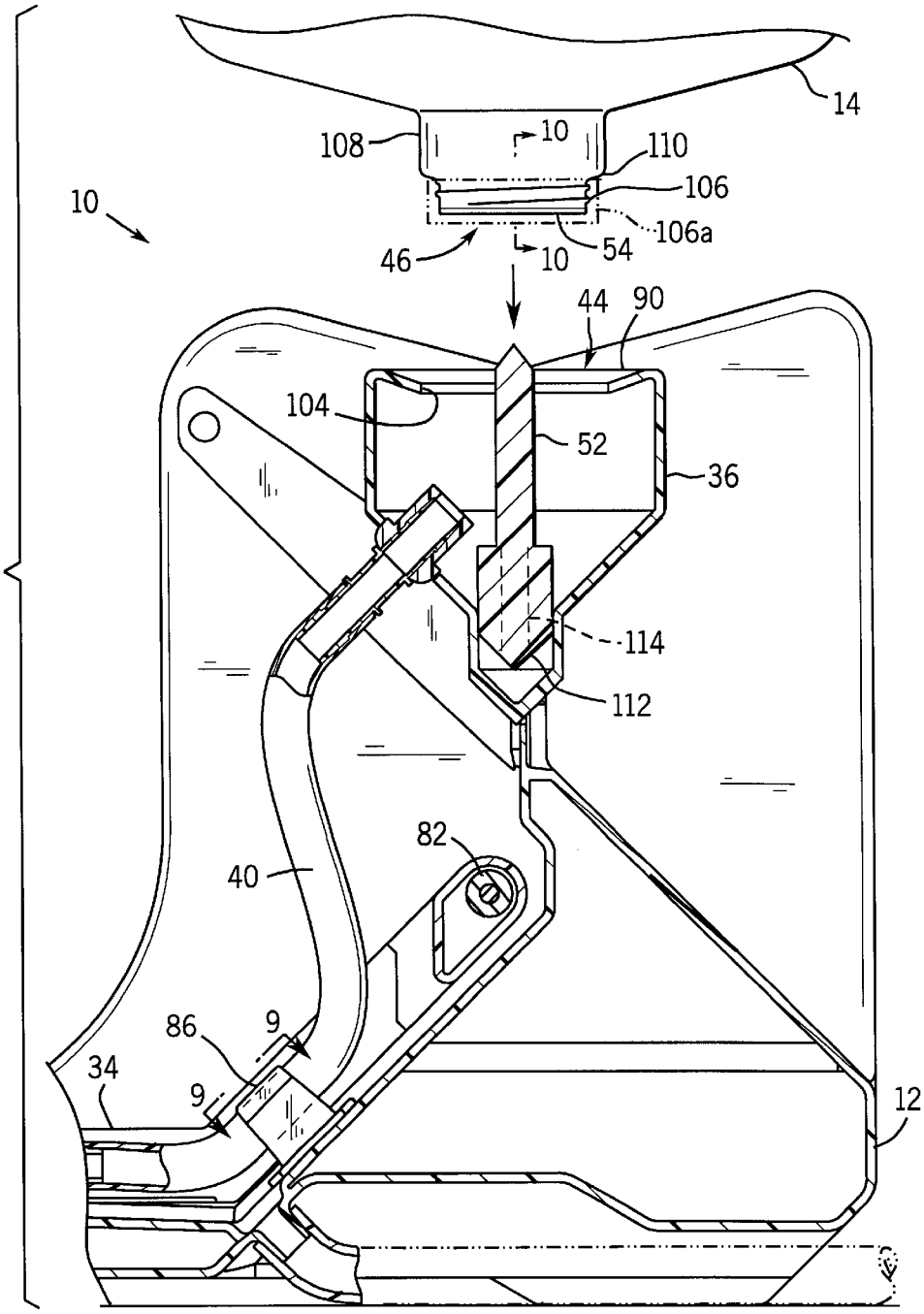
FIG. 8 is a fragmentary right-side sectional elevation view of a portion of the eye wash station of FIG. 1.

FIG. 1 shows a portable eye wash station 10 according to a preferred embodiment. Eye wash station 10 includes an elevated tank 14 that rests upon a pedestal 12. Pedestal 12 includes a generally horizontally disposed base portion 16 which is provided a lower surface (shown as projecting feet 18 in FIG. 5) by which eye wash station 10 may be placed upon a flat surface such as a table top, shelf, pickup truck bed, etc. As shown in FIGS. 3 and 8, tank 14 may be removed from pedestal 12 for refilling, cleaning, etc., and includes a narrow portion 20, ribs 22, and depressions 24, by any or all of which it may be easily grasped, carried, and handled by a worker. Pedestal 12 also includes a generally vertically disposed tank support portion 26 for supporting tank 14 in its elevated position. Tank support portion 26 has an upper surface with a retaining profile 28 which coacts with a corresponding retaining profile 50 of a lower surface of tank 14. Retaining profile 28 may have a V-shape (as shown) or have another shape which resists sliding of one body upon another. Tank 14 may be secured to pedestal 12.

Figure 2:
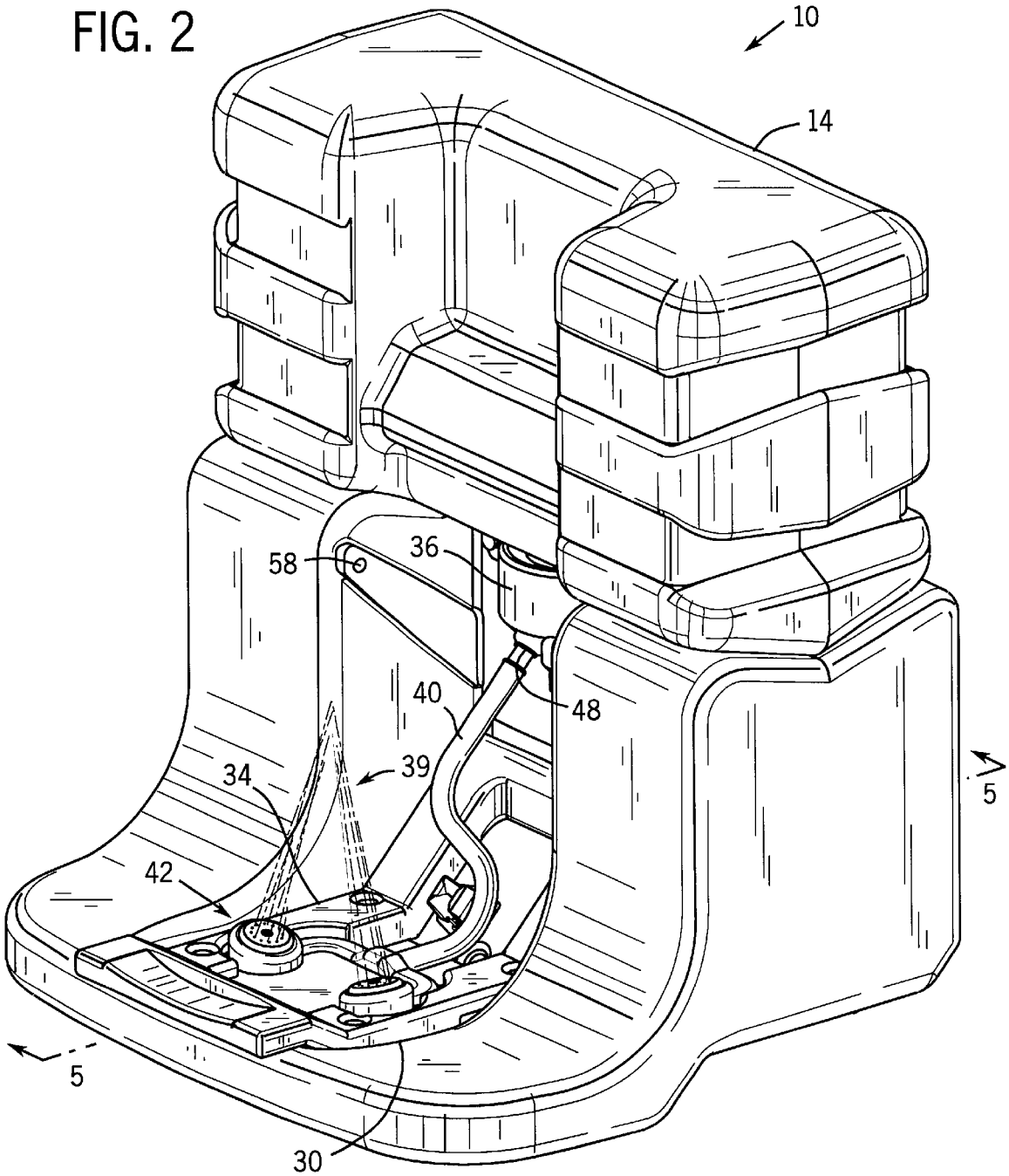
FIG. 2 is a perspective view of the eye wash station showing the dispensing arm in an operating position.

Base portion 16 includes a basin 30 having a fluid drain 32. A dispensing arm 34 is pivotally mounted to pedestal 12 so that it can be pivoted to an upper storage (or stowed) position as shown in FIG. 1 or to a lower (deployed or operating) position as shown in FIG. 2. A cover 60 of dispensing arm 34, shown assembled to dispensing arm 34 with four screws 62, provides surface for application of indicia such as manufacturer's identification plate, instructions regarding use and/or maintenance, etc.

FIG. 2 shows eye wash station 10 with dispensing arm 34 disposed downwardly within basin 30 in an operating position. A constant level reservoir 36 receives fluid 38 from tank 14, and is connected by a conduit 40 (e.g., a length of flexible hose or tubing) to dispensing arm 34. Reservoir 36 may be constructed (e.g., molded) integral with pedestal 12, or may be molded or fabricated separately and assembled to pedestal 12 by use of interlocking tabs and slots or bumps and depressions, fasteners, adhesive, thermal or solvent welding, etc. Dispensing arm 34 includes a flow outlet 42, which receives fluid 38 from conduit 40 and dispenses it upon a user's eyes in a fluid spray 39 (shown in FIGS. 6 and 7).

FIG. 3 is an exploded view showing eye wash station 10. Pedestal 12 is shown as an integrally molded unit, but can instead be assembled of separate molded or fabricated base and tank support portions. Pedestal 12 includes reservoir 36, which is provided a receptacle 44, configured as a generally cylindrically shaped opening in reservoir 36. Tank 14 includes a tank outlet 46 (shown in FIG. 8) which is shown configured as a generally cylindrically shaped projection for snugly fitting within receptacle 44, so that tank 14 is engaged with pedestal 12.

Tank support portion 26 includes V-shaped profile 28 which cooperates with V-shaped profile 50 of tank 14 to prevent tank 14 from rotating with respect to pedestal 12 when tank outlet 46 is engaged with receptacle 44. Reservoir 36 includes a piercing part 52, which has a sharp end disposed upwardly for penetrating a seal 54 (shown in FIGS. 10 and 11) which covers tank outlet 46. Fluid 38 within tank 14 is thus kept isolated from a dirty or dusty environment during installation of tank 14 to pedestal 12 until the last moment of engagement with reservoir 36. Piercing part 52 may be secured to a lower portion of reservoir 36 by use of fasteners, adhesives, solvent or thermal welding, etc., or may be molded or fabricated integral with reservoir 36. Piercing part 52 may include grooves 114 (shown in FIG. 4), so that a bottom portion 112 of reservoir 36 will serve as a sediment bowl.

Base portion 16 includes basin 30 (shown on FIG. 3) which is provided fluid drain 32, for collecting fluid spray 39 after discharge and draining it to a suitable receptacle (e.g., a pail). (Spent fluid spray 39 is thereby kept from wetting the floor under a user's feet and making it slippery, and is also retained for recovery of contact lenses and for subsequent chemical analysis, if needed to identify the contaminant that was rinsed from the user's eyes.)

Dispensing arm 34 is retained in its upwardly disposed stowed position by a detent notch 56 on dispensing arm 34 and a detent boss 58 on pedestal 12 (or alternatively by any suitable method known to those skilled in the art ). Dispensing arm 34 may be fabricated with an internal passage (shown in FIG. 6) for distributing fluid 38 to flow outlet 42. Dispensing arm 34 may be fashioned as an integral unit (e.g., by injection molding) or may be assembled as shown of a molded portion and a cover 60, in which event cover 60 can be sealed to the molded portion by a gasket or a sealant and secured with fasteners (e.g., self-tapping screws 62). Dispensing arm 34 includes flow outlet 42 (shown also in FIG. 7), through which fluid 38 (not shown) may spray upon a user's eyes in a fluid spray 39. Flow outlet 42 includes a pair of openings 64 in dispensing arm 34, each opening 64 provided with an associated spray head 66, a seal 68 (e.g., an O-ring), a filter 70, a threaded member 72, and a fastener (e.g., a machine screw 98). Threaded member 72 includes three radially projecting arms 74 configured to bear upon the inner rim of each opening 64 within dispensing arm 34 and a threaded central aperture, so that it functions as a nut to engage machine screw 98 which secures spray head 66, seal 68, and filter 70 to dispensing arm 34. According to alternative embodiments, one or more spray heads may be molded, or otherwise constructed, integral with dispensing arm 34.

Dispensing arm 34 also includes a first tube stub 76 open to a passage (not shown) within dispensing arm 34 and configured to engage a first end of conduit 40. A second end of conduit 40 is engaged to a second tube stub, shown as a barbed hose coupler 80, which is secured to reservoir 36 at an opening 48 through a wall of reservoir 36, in the illustrated instance by a rubber grommet 78 which is configured to have a tight fit to both the outside of barbed hose coupler 80 and the inside of opening 48. Grommet 78 thereby both frictionally secures and seals barbed hose coupler 80 to reservoir 36. Dispensing arm 34 further includes two pivot pins 82 which engage pivot apertures 84 located within surfaces of pedestal 12 and allow dispensing arm 34 to be pivoted with respect to pedestal 12. A valve (shown as a pinch valve 86 in FIG. 9) is affixed to pedestal 12 by two fasteners (e.g., self-tapping screws 62).

Figure 4:
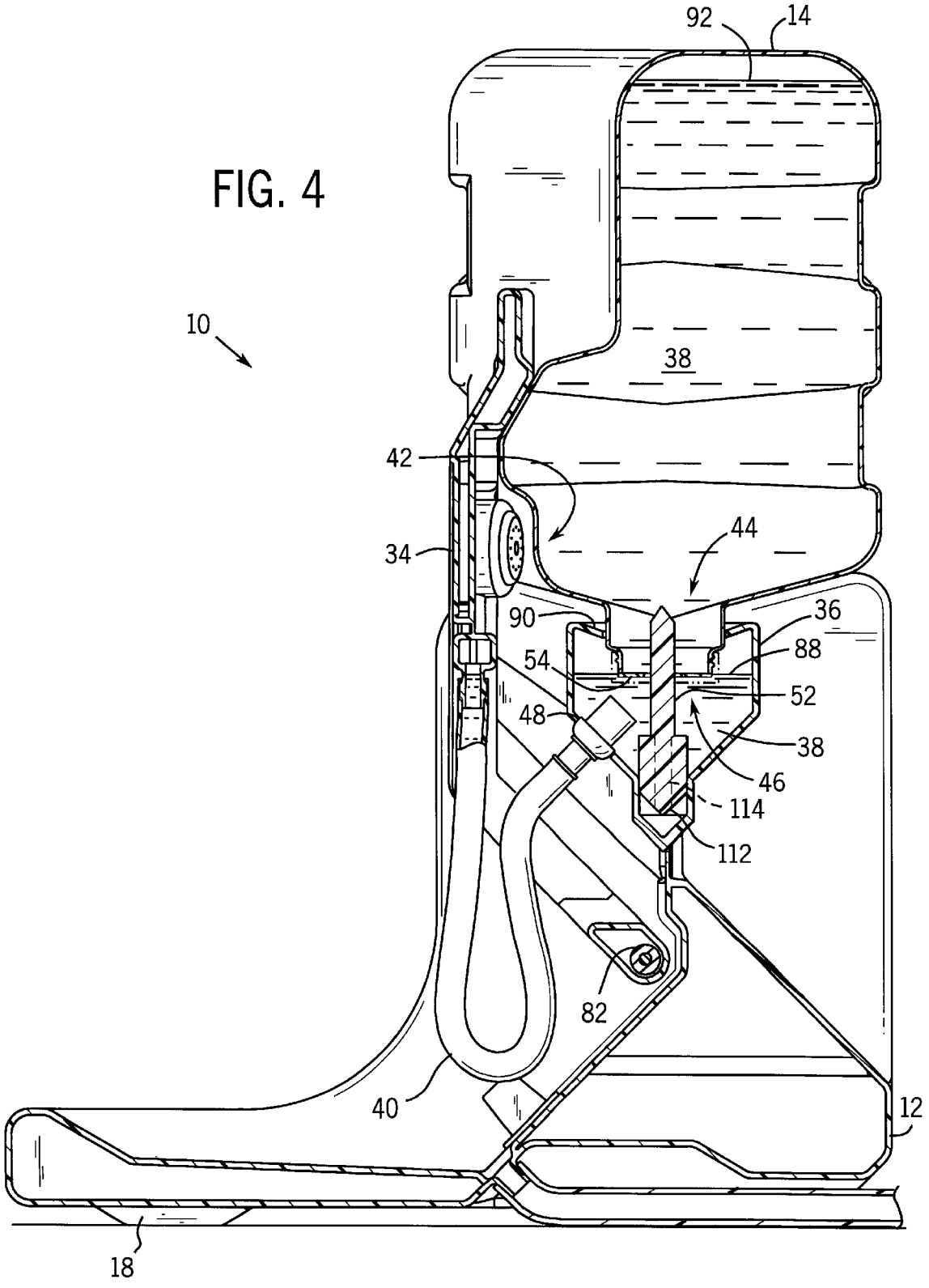
FIG. 4 is a right-side sectional elevation view taken at line 4—4 of FIG. 1.

FIG. 4 is a horizontal sectional elevation view of eye wash station 10 showing dispensing arm 34 upwardly disposed in its stowed position. Tank 14, filled with fluid 38, has been installed to pedestal 12 and piercing part 52 has punctured membrane-like seal 54 (which covered and sealed tank outlet 46). Fluid 38 fills reservoir 36 to a reservoir fluid level 88 which is substantially at the elevation of tank outlet 46, and air has been free to "bubble" upwardly through tank outlet 46 to a tank fluid level 92. When the level of fluid 38 within reservoir 36 reaches reservoir fluid level 88, tank outlet 46 is sealed by fluid 38 against entry of air into tank 14, which prevents flow of fluid 38 out of tank 14 into reservoir 36. Reservoir 36 is a constant level reservoir; fluid 38 will flow out of tank 14 into reservoir 36 only to maintain the level of fluid 38 within reservoir 36 to reservoir fluid level 88. Between intermittent uses of eye wash station 10, dispensing arm 34 remains in its stowed position, flow outlet 42 is above reservoir fluid level 88, and no fluid 38 may flow through conduit 40. A rim 90 forming receptacle 44 inhibits air circulation upon the surface of fluid 38 within reservoir 36 sufficiently to preclude a significant rate of evaporation of fluid 38. With dispensing arm 34 in its stowed position, reservoir 36 will retain reservoir fluid level 88, and tank 14 will retain tank fluid level 92.

Figure 5:
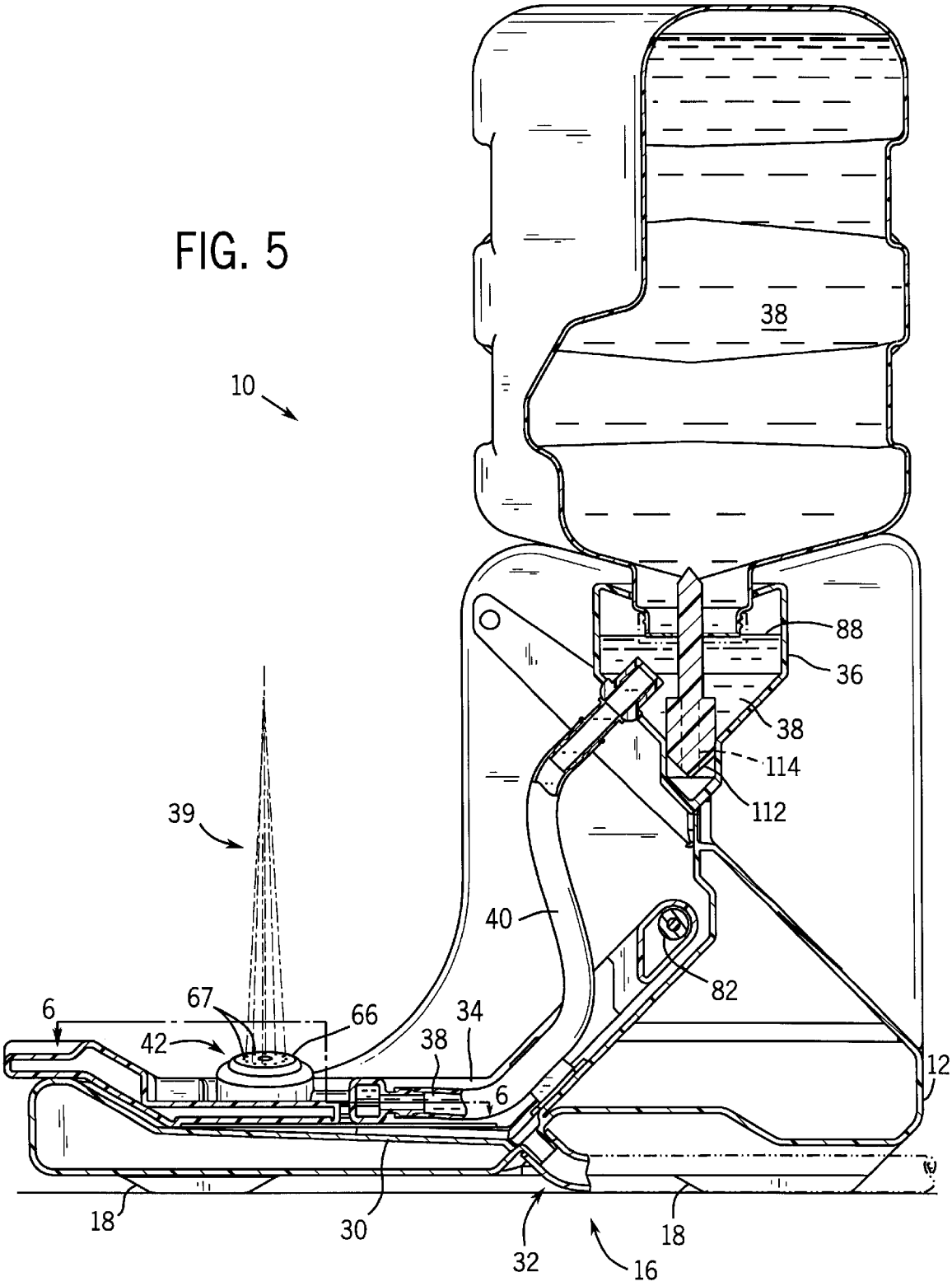
FIG. 5 is a right-side sectional elevation view taken at line 5—5 of FIG. 2.

FIG. 5 is a horizontal sectional elevation view of eye wash station 10 showing dispensing arm 34 in its operating position within basin 30. Flow outlet 42 is now lower in elevation than is reservoir fluid level 88, allowing fluid 38 to flow (by gravity) from reservoir 36 through conduit 40 to flow outlet 42 within dispensing arm 34; fluid 38 sprays upwardly through spray heads 66 as a fluid spray 39. Spent fluid spray 39 then falls back into dispensing arm 34, from which it is collected by basin 30 and may be drained by gravity through fluid drain 32. Flowing of fluid 38 from reservoir 36 at least partially empties reservoir 36, lowering the level of fluid 38 within reservoir 36 below reservoir fluid level 88 and below tank outlet 46 (shown in FIG. 5). Air enters tank outlet 46 and "bubbles" upwardly to tank level 92; fluid 38 flows downwardly from tank 14 into reservoir 36 to maintain reservoir fluid level 88 which provides a substantially continuous flow rate through conduit 40 until dispensing arm 34 is raised or tank 14 is emptied.

FIG. 5 also shows feet 18, which form a flat bottom surface for resting of eye wash station 10 upon a flat surface. Feet 18 may be molded integral with base portion 16 or pedestal 12 or fabricated separately and affixed to base portion 16.

Figure 6:
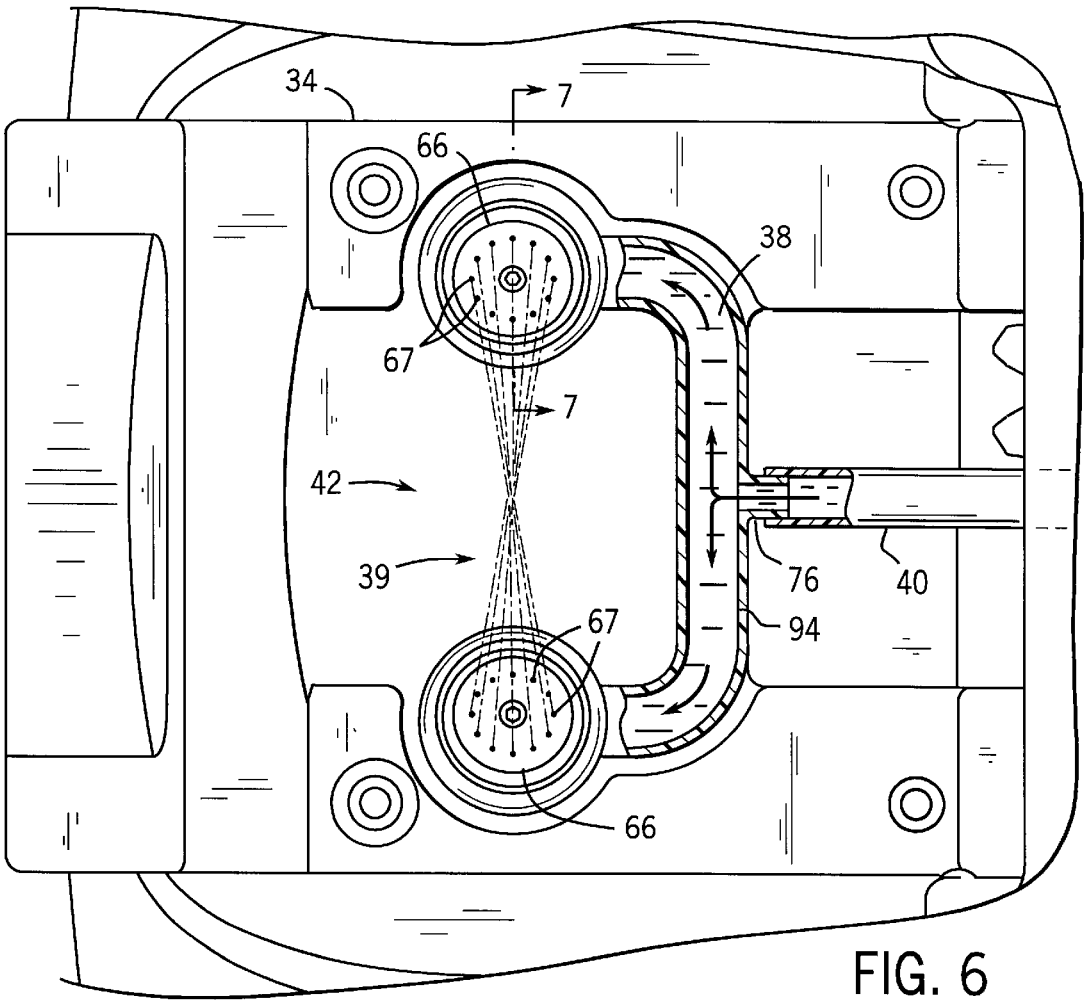
FIG. 6 is a fragmentary plan view taken at line 6—6 of FIG. 5.

FIG. 6 is a fragmentary sectional plan view of dispensing arm 34 and shows spray heads 66 of flow outlet 42, first tube stub 76 connected to conduit 40, and a passage 94 of dispensing arm 34 connecting first tube stub 76 with spray heads 66. Passage 94 symmetrically connects both spray heads 66 to single first tube stub 76 (in the manner of a plumbing tee receiving fluid through a side port and delivering fluid through both run ports), allowing both spray heads 66 to receive and deliver fluid spray 39 at substantially equal rates of flow.

Figure 7:
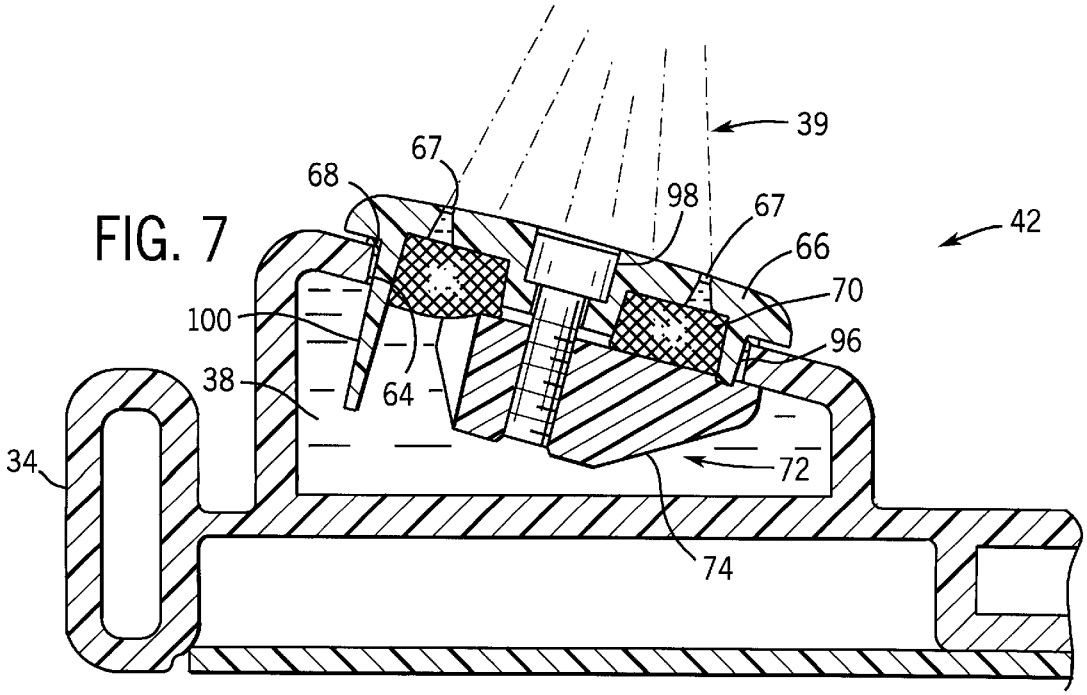
FIG. 7 is a fragmentary front sectional elevation taken through line 7—7 of FIG. 6.

FIG. 7 is a fragmentary sectional elevation view through a portion of dispensing arm 34 including a portion of flow outlet 42. Machine screw 98, threaded into a central aperture within threaded member 72, is used to clamp seal 68 and the rim of opening 64 within dispensing arm 34 between a peripheral flange of spray head 66 and radially disposed arms 74 of threaded member 72. Threaded member 72 also retains filter 70 within an annular cavity disposed within a lower surface of spray head 66. Spray head 66 includes apertures 67 for forming fluid spray 39 from fluid 38, as well as an annular pilot surface 96 for centering spray head 66 within opening 64. Pilot surface 96 is provided a downwardly disposed tang 100 located at a distance from machine screw 98 which is less than is the radial length of radially projecting arms 74, so that it will interfere with rotation of threaded member 72 and thereby hold it against rotation while machine screw 98 is being threaded into threaded member 72.

FIG. 8 shows tank 14 about to be installed upon pedestal 12. Fluid 38 (shown in FIG. 5) is retained within tank 14 by seal 54, which covers tank outlet 46. Lowering tank 14 further upon pedestal 12 will allow piercing part 52 to puncture and penetrate seal 54, whereupon fluid 38 will flow by gravity into reservoir 36 of pedestal 12 through receptacle 44 within rim 90 located at or near the top of reservoir 36. Receptacle 44 within rim 90 has a first diameter (or inlet stage 104 of pedestal 12). Tank outlet 46 is configured generally as a stepped cylinder having a first stage 106 of a second diameter which is significantly smaller than, and a very loose fit to, the first diameter of inlet stage 104. Tank outlet 46 also has a second stage 108, of a third diameter which is only slightly smaller than is the first diameter of inlet stage 104. First stage 106 of tank outlet 46 therefore allows a quick, easy, and approximate centering of tank outlet 46 with respect to inlet stage 104 within receptacle 44 during installation of tank 14, while second stage 108 of tank outlet 46 provides a more accurate centering of tank outlet 46 with respect to inlet stage 104 within receptacle 44 during the final portion of installation. A step 110 between first stage 106 and second stage 108 is provided a lead-in chamfer or radius, as shown, to facilitate transition from first stage 106 engagement to second stage 108 engagement with inlet stage 104. Rim 90 is conically sloped as shown to facilitate entry of first stage 106 into inlet stage 104. Second stage 108 diameter is made slightly smaller than is the diameter of inlet stage 104, to provide a small air gap for venting of reservoir 36 and, when fluid level within reservoir 36 is below reservoir fluid level 88 (shown in FIG. 5), of tank 14. A lid **124*a* is associated with a particularly preferred embodiment, and is described below. Lid 124*a* provides a first stage 106*a* of engagement of tank 14 with receptacle 44**.

Figure 9:
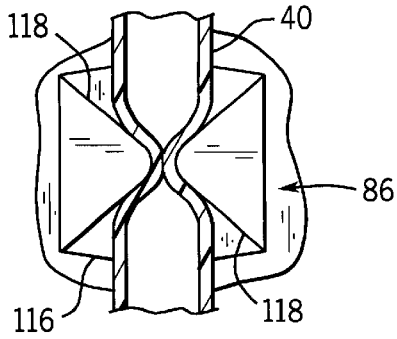
FIG. 9 is a detail of a pinch valve taken at line 9—9 of FIG. 8.

FIGS. 8 and 9 show engagement of conduit 40 with a valve, shown as pinch valve 86, for shutting off, or preventing, flow of fluid 38 through conduit 40 when dispensing arm 34 is in an operating position but flow of fluid 38 through flow outlet 42 is not desired (e.g., while a worker is performing a maintenance or cleaning task). Valve 86 includes a base portion 116 for mounting of valve 86 upon a surface of pedestal 12, and two projections 118 which are affixed to base portion 116 with a gap between them. The width of the gap between projections 118 is dimensionally slightly less than is twice the wall thickness of the flexible tube or hose used for conduit 40, so that a worker maintaining eye wash station 10 with dispensing arm 34 disposed in its operating position can prevent unwanted flow to and through flow outlet 42 (shown in FIG. 5) by grasping conduit 40 and manually inserting it into the gap between projections 118 of valve 86, thereby pinching conduit 40 shut in a "disabled" (or "closed" or "off") configuration. Upon return of dispensing arm 34 back up into its stowed position, conduit 40 is pulled out of engagement with valve 86 and thereby automatically resets to an "enabled" position; when dispensing arm 34 is again lowered to an operating position fluid 38 will flow through conduit 40. The length of conduit 40 and the position of valve 86 is selected to be long enough so that a portion of it will reach and be engageable with valve 86; valve 86 must be located upon a surface of eye wash station 10 which does not move with a pivoting of dispensing arm 34 (e.g., pedestal 12) and which is far enough from pivot 82 for conduit 40 to be certain to be disengaged from valve 86 upon pivoting of dispensing arm 34 to its stowed position.

Figure 10:
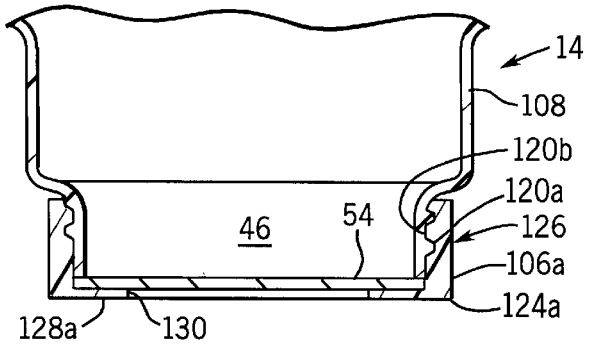
FIGS. 10 and 11 are fragmentary sectional elevation views of the outlet of the tank of the eye wash station according to exemplary embodiments.
Figure 12:
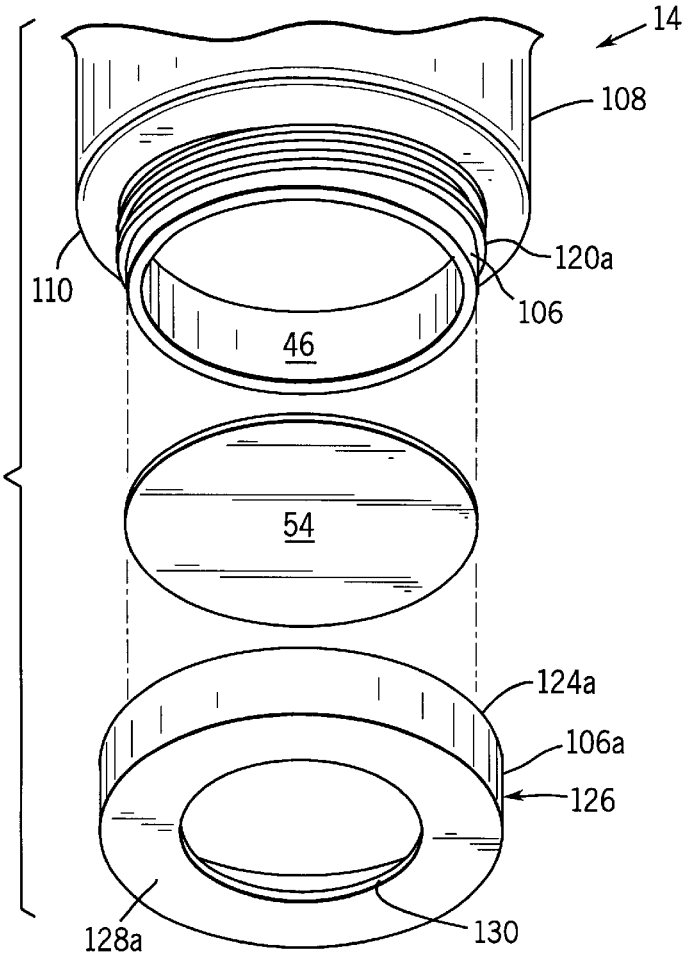
FIG. 12 is a fragmentary exploded perspective view of the outlet of the tank of FIG. 10.

FIGS. 10 and 12 show, according to exemplary embodiments of eye wash station 10, a tank shown as tank 14 provided at tank outlet 46 with a seal 54 (shown as a gasket) and a removable protective lid **124*a* (e.g. generally ring-shaped). Tank 14 is provided with threads 120*a* at tank outlet 46, threads 120*a* being generally of the form used for removable caps or lids of jars and wide-mouthed bottles. Lid 124*a* includes threads 120*b*, configured to engage threads 120*a* of tank 14 and thereby allow lid 124*a* to be rotatably secured to and removed from tank 14 at tank outlet 46. Lid 124*a* also includes a top portion 128*a* , which is provided an opening 130 (and further includes a peripheral outer surface 126 which may be provided with flutes, knurling, or the like to facilitate installation and removal by a worker without use of a tool). Seal 54 is held or clamped by lid top portion 128*a* upon the rim of tank outlet 46, when lid 124*a* is threaded onto tank outlet 46, to form a fluid-tight closure; a generally central portion of seal 54 exposed by opening 130 is punctured by piercing part 52 during installation of tank 14 to pedestal 12. (The outside diameter of lid 124*a* is smaller than is the diameter of second stage 108 of tank 14, and thereby constitutes a first stage 106*a* for guiding tank 14 into engagement with receptacle 44.) However, fluid 38 will not flow from tank outlet 46 until seal 54 has been pierced, even when tank 14 is inverted for installation. Tank 14 can be removed from eye wash station 10 (e.g. when empty), emptied and cleaned, refilled, and sealed by a worker at or near the point of use with a new seal 54 and lid 124***a* (a new or former). Tank 14 may then be reinstalled to eye wash station 10, or kept in storage for later use as a replacement. According to any preferred embodiment, the seal may be of any material used for a seal protective (i.e. against spillage, fluid-tight) in connection with jars, bottles or other containers for supplying or dispensing fluids or other items.

Figure 11:
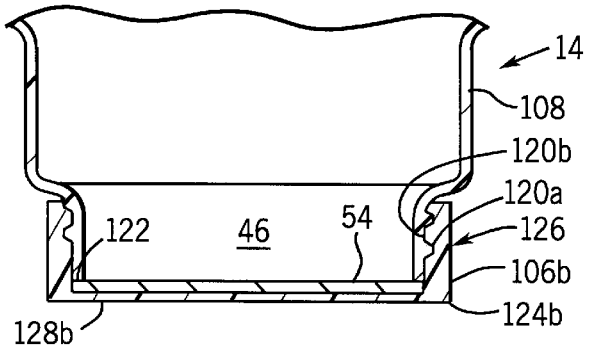

FIG. 11 shows an alternative embodiment of eye wash station 10, in which tank 14 is provided a seal 54 and a protective lid 124*b* . A top portion 128*b* of protective lid 124*b* does not include an opening, and completely covers seal 54. Protective lid 124*b* must therefore be removed from tank 14 before tank 14 is installed to eye wash station 10. The major diameter of threads 120*a* of tank 14 is smaller than is the diameter of second stage 108 of tank 14, and threads 120*a* thereby constitute a first stage 106*b* for guiding tank 14 into engagement with receptacle 44. Seal 54 is provided at a perimeter with a layer of an adhesive 122 so that it remains in place upon tank outlet 46 (even after protective lid 124*b* has been removed) when tank 14 is inverted for installation upon pedestal 12 and thereby continues to retain fluid 38 within tank 14. This embodiment provides a greater level of protection of seal 54 (e.g., for shipping of a new tank 14 containing fluid 38 from a manufacturing facility to a remote point of use).

The user may remove and discard protective lid 124*b* from tank 14 and install tank 14 upon pedestal 12 without a lid, or may replace protective lid 124*b* with lid 124*a* which does not have to be removed from tank 14 before installation of tank 14 upon pedestal 12 and provides additional assurance of seal 54 remaining in contact with tank outlet 45. The wall thickness of lid 124*a* is small relative to the diameter of tank outlet 46, and the guiding function of a first stage 106*b* or 106*a* is performed by the major diameter of threads 120*a* of tank 14 or by the outside diameter of lid 124*a* respectively.

According to any preferred embodiment, the tank may thus be removed and reused in a procedure wherein the lid is removed, the pierced or ruptured gasket (or seal) is removed, the tank is refilled with fluid (e.g. after cleaning), a new gasket (or seal) is installed and secured by the lid, to be pierced or ruptured by the piercing part when the tank is installed on the pedestal. The seal will serve to prevent or substantially reduce fluid spillage when the tank is inverted for installation. The seal may include a foil material, a plastic material, an elastomeric material, or any other type of material known by those who may review this disclosure for such purposes.

While the invention has been described with reference to preferred embodiments, it is not intended to be limited to such embodiments. For example, the basin need not be associated with the pedestal but may instead be affixed to, or a portion of, the dispensing arm. Spray heads may be provided protective caps (e.g., snap-on) which may be associated with the pedestal and automatically disengage the spray heads when the dispensing arm is lowered. The reservoir inlet stage may be a tight fit to the tank second outlet stage, and an air vent, which may include a filter, added to the reservoir. The method steps may be practiced in a variety of sequences. Accordingly, the appended claims shall be construed to include other variations and embodiments of the invention which may be made by those skilled in the art without departing from the spirit and claim of the present invention.

What is claimed is:

1. An eye wash station for dispensing a fluid which comprises:

a tank;

a pedestal having a tank support portion including a reservoir configured to maintain the fluid at a reservoir level when the tank is installed;

a dispensing arm providing a flow outlet mounted to the pedestal for movement between a stowed position wherein the flow outlet is above the reservoir level and an operating position wherein the flow outlet is below the reservoir level; and a conduit coupling the reservoir to the flow outlet to allow the flow of the fluid from the reservoir to the flow outlet when the dispensing arm is in the operating position.

2. The eye wash station of claim 1 wherein the tank support portion of the pedestal is in a substantially vertical orientation.

3. The eye wash station of claim 1 wherein the reservoir and pedestal are formed as an integral assembly.

4. The eye wash station of claim 1 wherein the reservoir and pedestal are separate units.

5. The eye wash station of claim 1 wherein the pedestal also includes a basin portion, wherein the tank support portion of the pedestal and the basin portion of the pedestal are formed as a unitary assembly.

6. The eye wash station of claim 1 further comprising a fluid drain coupled to the pedestal.

7. The eye wash station of claim 1 wherein the conduit is a flexible hose.

8. The eye wash station of claim 1 further comprising a valve to restrict flow of fluid through the hose when the tank is installed and for servicing of the eye wash station.

9. The eye wash station of claim 8 wherein the valve is a pinch valve.

10. The eye wash station of claim 8 wherein the valve is configured to reset to the open position when the dispensing arm is raised to the stowed position.

11. The eye wash station of claim 1 wherein the tank includes a lid with a seal that is pierced by a piercing part in the reservoir of the pedestal when the tank is installed.

12. The eye wash station of claim 1 wherein the tank is refillable and is provided with a seal in the form of a gasket secured on the lid of the tank by a threaded ring.

13. The eye wash station of claim 1 wherein an outlet end of the tank is configured in a shape to fit into a receptacle in the pedestal having a corresponding shape to provide a snug fit.

14. The eye wash station of claim 13 wherein the outlet end of the tank includes an outlet having a first stage having a first outer diameter and a second stage having a second outer diameter and the pedestal includes a receptacle having an inlet stage wherein the first outer diameter is larger than the second outer diameter and so that when the tank is installed within the pedestal the first stage of the tank is installed within the inlet stage of the pedestal before the second stage of the tank is installed within the inlet stage of the pedestal.

15. The eye wash station of claim 14 wherein the first stage of the tank has a cylindrical shape and the second stage of the tank has a cylindrical shape and wherein the first outer diameter is substantially constant along the length of the first stage of the tank and the second outer diameter is substantially constant along the length of the second stage of the tank.

16. The eye wash station of claim 15 wherein the first stage of the tank fits loosely within the inlet stage of the pedestal and the second stage of the tank fits snugly within the inlet stage of the pedestal.

17. The eye wash station of claim 1 wherein an outlet end of the tank is configured in a two-stage cylindrical shape to provide a snug fit into a receptacle in the pedestal.

18. The eye wash station of claim 1 wherein the pedestal has an upper surface with a retaining profile and the tank has a bottom surface with a corresponding profile received within the retaining profile of the upper surface of the pedestal to facilitate a secure fit between the tank and the pedestal.

19. The eye wash station of claim 1 wherein the upper surface of the tank support portion of the pedestal has a V-shaped retaining profile and the bottom surface of the tank has a corresponding profile to facilitate a secure fit of the tank and the pedestal.

20. The eye wash station of claim 1 where the pair of spray heads are integrated within the dispensing arm.

21. The eye wash station of claim 1 further comprising means for securing the tank to the pedestal.

22. The eye wash station of claim 1 wherein the tank has an outlet provided with a seal.

23. The eye wash station of claim 22 wherein the seal is secured to the outlet of the tank by an adhesive.

24. The eye wash station of claim 22 wherein the seal is secured to the outlet of the tank by a lid.

25. The eye wash station of claim 22 wherein the seal is adapted to be ruptured by a piercing part in the reservoir of the pedestal when the tank is installed.

26. The eye wash station of claim 1 further including a pair of spray heads coupled to the flow outlet to provide a spray of the fluid.

27. An eye wash station for dispensing a fluid which comprises:

a tank including a first stage and a second stage, the first stage having a first outer dimension and the second stage having a second outer dimension smaller than the first outer dimension;

a pedestal having a receptacle with an inlet stage so that when the tank is installed within the pedestal the first stage of the tank is installed within the inlet stage of the pedestal before the second stage of the tank is installed within the inlet stage of the pedestal; and a flow outlet coupled to the pedestal.

28. The eye wash station of claim 27 further including a reservoir fluidly coupled with the tank and configured to maintain the fluid at a reservoir level when the tank is installed.

29. The eye wash station of claim 28 further including a dispensing arm pivotally mounted to the pedestal for movement between a stowed position where the flow outlet is above a reservoir level and an operating position wherein the flow outlet is below the reservoir level.

30. The eye wash station of claim 27 wherein the first stage of the tank has a cylindrical shape with a first outer diameter and the second stage of the tank has a cylindrical shape with a second outer diameter and wherein the first outer diameter is substantially constant along the length of the first stage of the tank and the second outer diameter is substantially constant along the length of the second stage of the tank.

31. The eye wash station of claim 30 wherein the first stage of the tank fits loosely within the inlet stage of the pedestal and the second stage of the tank fits snugly within the inlet stage of the pedestal.

32. An eye wash station for dispensing a fluid which comprises:

a first plenum;

a second plenum coupled to the first plenum, the second plenum being configured to maintain the fluid at a second plenum level when the first plenum is installed;

a pedestal configured to support the first plenum; and a dispenser providing a flow outlet mounted to the pedestal for movement between a stowed position where the flow outlet is above the second plenum level and an operating position wherein the flow outlet is below the second plenum level.

33. The eye wash station of claim 32 wherein the first plenum is a tank.

34. The eye wash station of claim 33 wherein the second plenum is a reservoir.

35. The eye wash station of claim 32 wherein the dispenser is a dispensing arm.

36. An eye wash station for dispensing a fluid which comprises:

a tank;

a pedestal including a reservoir configured to maintain the fluid at a reservoir level when the tank is installed;

a flow outlet mounted to the pedestal for movement between a stowed position where the flow outlet is above the reservoir level and an operating position wherein the flow outlet is below the reservoir level;

a conduit coupling the reservoir to the flow outlet to allow the flow of the fluid from the reservoir to the flow outlet when the dispensing member is in the operating position; and a flow control element having a gap configured to receive the conduit and restrict the flow of the fluid when the conduit engages the gap.

37. The eye wash station of claim 36 wherein the flow control element is in the open position when the dispensing arm is raised to the stowed position.

38. The eye wash station of claim 36 wherein the flow control element includes a base configured to mount the flow control element to the pedestal and includes a plurality of projections extending from the base.

39. The eye wash station of claim 36 wherein the flow control element includes a plurality of projections which define the gap.

40. The eye wash station of claim 39 wherein the gap has a width and the conduit has a wall with a wall thickness and wherein the width of the gap is less than twice the wall thickness of the conduit.

41. The eye wash station of claim 39 wherein flow of the fluid is restricted when the conduit is inserted between the plurality of projections.

42. The eye wash station of claim 36 wherein the flow control element is a pinch valve.

43. The eye wash station of claim 36 wherein the gap has a constant width.

44. The eye wash station of claim 36 wherein the gap has a variable width.

45. The eye wash station of claim 44 wherein the variable width is provided by a V-shaped profile.

* * * * *